US006530247B2

(12) United States Patent
Moores

(10) Patent No.: US 6,530,247 B2
(45) Date of Patent: Mar. 11, 2003

(54) EXTERNAL DOOR LOCK MECHANISM INVENTION

(76) Inventor: Brian R. Moores, 2300 B Naudain St., Philadelphia, PA (US) 19146-1150

( * ) Notice: Subject to any disclaimer, the term of this patent is extended or adjusted under 35 U.S.C. 154(b) by 0 days.

(21) Appl. No.: 09/757,776

(22) Filed: Jan. 10, 2001

(65) Prior Publication Data

US 2002/0088255 A1 Jul. 11, 2002

(51) Int. Cl.[7] ..... E05B 65/06

(52) U.S. Cl. ..... 70/14; 70/94; 70/101; 70/DIG. 64; 292/258; 292/259 R; 292/288; 292/289

(58) Field of Search ..... 70/14, 101, 91, 70/94, DIG. 64, DIG. 65, DIG. 66; 292/288–290, 296–298, 258, 343, 259 R

(56) References Cited

U.S. PATENT DOCUMENTS

| | | | | | |
|---|---|---|---|---|---|
| 4,821,538 | A | * | 4/1989 | Gray | 70/14 |
| 4,856,831 | A | * | 8/1989 | Roden, Jr. | 292/288 X |
| 5,268,809 | A | * | 12/1993 | Eschenburg | 70/58 X |
| 5,394,713 | A | * | 3/1995 | Harmon | 70/58 |
| 5,400,622 | A | * | 3/1995 | Harmon | 70/58 X |
| 5,556,143 | A | * | 9/1996 | Robinson | 292/288 X |
| 5,622,397 | A | * | 4/1997 | Rice et al. | 292/288 X |
| 5,719,831 | A | * | 2/1998 | Harmon | 70/58 X |
| 5,799,513 | A | * | 9/1998 | Nathan, III et al. | 70/19 X |
| 5,873,273 | A | * | 2/1999 | Vick | 70/94 X |
| 5,899,509 | A | * | 5/1999 | Ferguson et al. | 70/93 X |
| 5,924,751 | A | * | 7/1999 | Moore | 292/244 X |

FOREIGN PATENT DOCUMENTS

| | | | | |
|---|---|---|---|---|
| FR | 952964 | * | 11/1949 | 70/101 |

* cited by examiner

*Primary Examiner*—Lloyd A. Gall
(74) *Attorney, Agent, or Firm*—Robert B. Famiglio; Famiglio & Associates

(57) ABSTRACT

A portable door security mechanism which allows an existing door to be temporarily secured from the non-hinged side of the door without destruction or penetration of the door, the door frame or any existing components of the door, is disclosed. The device uses a cylindrical locking pin which is designed to slip underneath the door to be secured and rotated such that part of the locking pin protrudes upward to prevent the door from opening from the inside. The locking pin is secured to a base plate member and a cover plate which, when interlocked over a portion of the locking pin, is disposed to accept a conventional pad lock or similar device. The disclosed security mechanism can be folded through a hinge mechanism for convenience and can be applied or removed quickly without having access to the interior side of the door.

7 Claims, 4 Drawing Sheets

EXTERNAL DOOR LOCK MECHANISM INVENTION

BACKGROUND OF THE INVENTION

The present invention relates to the field of security lock systems, and more particularly a security locking system that allows locking of virtually any interior or exterior door from the non-hinged side of such door, without reliance on the doors installed lock system or any destructive means of affixing locks to said door. Locking systems that exist in the prior art for temporary securing of a door require access to the interior area of a premises to be secured before prior art devices can function.

An example of a prior art device is found in U.S. Pat. No. 4,653,785 issued to Tobey which is a temporary door lock structure disposed to allow temporary locking of a door using an external locking device such as a pad lock or combination lock in order to either defeat access through the door by someone having a key to the integrated lock for the door or to secure a door which does not have a lock on it at all. The short comings of this type of device is that it requires access into the premises to be secured in order to employ the device.

In Tobey, a device that appears to be constructed like an auxiliary clothes hanging bar such as those used over the top of a closet door is illustrated with a clamping plate disposed to accept a pad lock like device to secure the premises. As disclosed and as the invention is taught, Tobey does not allow securing of the door while the door is in the fully closed position. Also, such prior art has other short comings in that the invention in Tobey does not teach securing the door affixing device between two edges of opposing door frame components.

Likewise, U.S. Pat. No. 5,325,685 issued to Frank teaches another example of a portable door lock device which requires access to the interior structure of the door frame in order for the device to operate. Frank teaches a locking pin device which is affixed within the bolt receptacle as to allow the device to be locked into place to hold a door, from the hinged side of that door, from being opened from the outside. Once again, this example of the prior art devices illustrates the short comings and earlier inventions since the device does not allow securing of a premises from the non-hinged side of the door.

The disclosed invention is designed to lock virtually any door from the non-hinged side without relying on any installed, key-operated lock system within the existing door structure, and without screwing a hasp assembly into the door and doorjamb. The present invention is designed to be applied in various situations, including illegal break-in scenarios where an internal or external door is damaged and the property owner cannot secure the property without either a locksmith, the purchase of a replacement lock on short notice, or installation of destructive hasp apparatus and lock as a temporary solution. In situations where the door jamb at the lock point is damaged, only hasp apparatus would offer any protection from further unwanted entry. Such methods require additional destruction of the premises such as the application of nails or screws to be installed on both the door and the door jamb.

Other areas of use for the present invention would be for those who need to enforce court ordered evictions, foreclosures of apartments or properties, or the securing of premises for law enforcement reasons such as police seizures or after search warrants are served. In such events, usually a locksmith is necessary to secure the premises or otherwise resorting to a destructive, hasp apparatus-type lock system is necessary.

The present invention can also be used by members of the industrial or construction trades. In many instances, contractors and trade workers need to secure materials and tools on a job location that is either under construction and not yet secure, or in a location that is not secure with respect to leaving valuable and expensive tools, paperwork or technical drawings which may be confidential. In such situations, individuals are forced to either transport their tools and equipment daily to and from the job site or hire security personnel so the equipment or materials are not left unattended. The latter solution is often prohibitively expensive.

The present invention differs from such conventional locking technology as may be in the prior art, by allowing any interior or exterior door to be secured from the outside or non-hinged side, quickly and nondestructively. Therefore, even a door which is not situated with a locking mechanism can be effectively secured without the need to damage the door structure, or to install temporary locks and other such related systems which require damage to the door structure by the application of fastening means such as screws and bolts.

SUMMARY OF THE INVENTION

The present invention relates to a portable and nondestructive door lock and security system comprising of three main parts , a base member, a security pin and a cover plate, along with a separate, conventional locking means such as a pad lock. With the components described, the door to be secured is essentially wedged between the base member which is compressed between the door jamb frame on either side of the door and the interior side of the door by the clamping action of the locking pin when it is secured in place. The security pin is oriented with a locking ring at its head end and a finger like protrusion at its tail end. The locking pin head is affixed to both the base member and the cover plate utilizing locking means, while the tail end of the pin is inserted under a door to be secured and rotated so that the tail protrudes on the hinged side of the door and above the bottom edge of the door. In such a fashion, attempting to open the door and swing it about its hinged axis would cause contact between the bottom interior edge of the door and the tail of the locking pin, thereby securing the door.

In operation, the locking pin is placed on the ground and rotated to be in the correct position to secure the door. The base member is then placed over the locking pin head such that the head, which is a disc like structure, protrudes through several slots that are available in the base member. The base member is situated such that it will contact either side of the door frame structure of the door to be secured. Thereafter, a cover plate is placed over the locking pin head such as to secure the locking pin so that it cannot be removed by rotation or by jocyling the base member. The base member is held firmly in contact with the door frame structure by the combination of the components.

Graduations on the sides of the base member allow the plate to be positioned between the vertical door jambs of virtually any door, regardless of the door jamb thickness, sizing, molding shape or door width. The base member is wide enough to accommodate most normal sized doors. It is not necessary to have exact dimensions or to have a variety of different size base members, or cover plates, in that the invention functions well without an exact fit, as will be appreciated by reference to the various drawings.

Both the base member and the cover plate contain oval shape holes in a variety of orientations which accept the head of the locking pin such that adjustments can be made in determining precisely how to orient the invention for a particular door position. The base member provides the primary structure to the device, transmitting any opening force of the door being transmitted through the locking pin to the door jambs which contact the opposite edges of the base member. The cover plate oval shaped holes are provided so that they essentially match the positions of the openings in the base member and served to secure the base member against the outer portion of the door so that base member cannot be removed once a locking means is affixed to the components as described.

When operationally positioned, the base member covers the security pin with the exception of that portion of the locking pin head which is protruding through the oval shaped holes in the base member. The cover plate, which in the preferred embodiment is a rectangular plate, also contains oval shaped holes matching the orientation of the holes or openings in the base member. Positioning the cover plate over the center portion of the base member, allowing the exposed head of the locking pin to pass through one of the oval shaped holes, the disclosed invention functions properly. When positioned properly, the base member with the portion of the locking ring protruding through one of the oval shaped holes, is then covered by the cover plate, allowing the same portion of the locking pin head to protrude through the oval shaped holes and the cover plate.

It will be appreciated that the locking pin head would be in a position to accept an external lock of any variety, including pad locks, combination locks or other fastening means. Once the present invention is applied to a door to be secured, the door cannot be opened with a key or forced opened from either the inside or the outside of the premises being secured. The advantage of the present invention is accomplishing this locking means with no screws or other destructive fastening means applied to any of the structure, including the door, door jamb or the frame. Locking means which may be used with the present invention is well known to those skilled in the art and it is not necessary that unusual locking devices be applied for the invention to be effective.

Accordingly, it is an object of the present invention to provide a door security system that allows, by completely nondestructive means, the locking of virtually any door from the non-hinged side of the door, without reliance on the presence, absence, or condition of the doors own lock mechanism. Another object of the present invention is to provide a door security system that allows, by completely nondestructive means, the locking from the non-hinged side of any door regardless of the width.

DETAILED DESCRIPTION OF THE INVENTION

Figure 1:
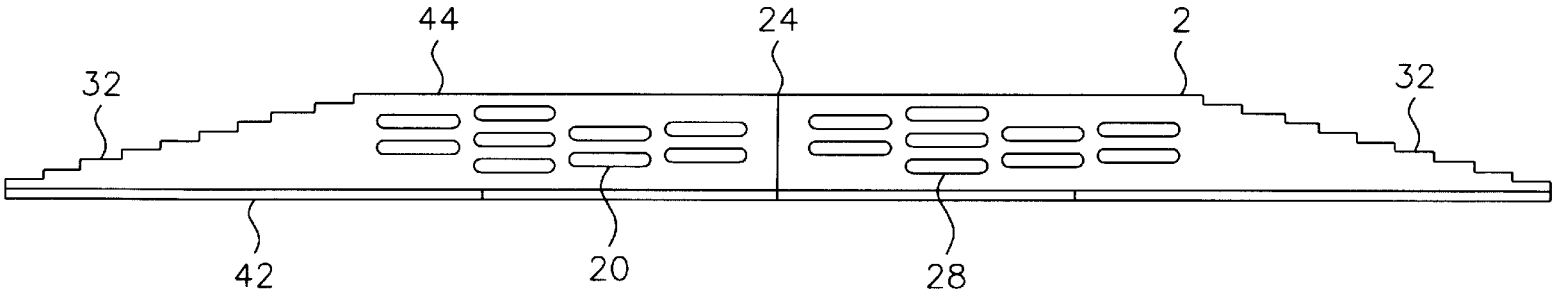
FIG. 1 is a plan view of the base member of the present invention, illustrating its general shape, dimensions, and the graduation or undulated edges used to adjust its fit between opposite door jambs.
Figure 2:
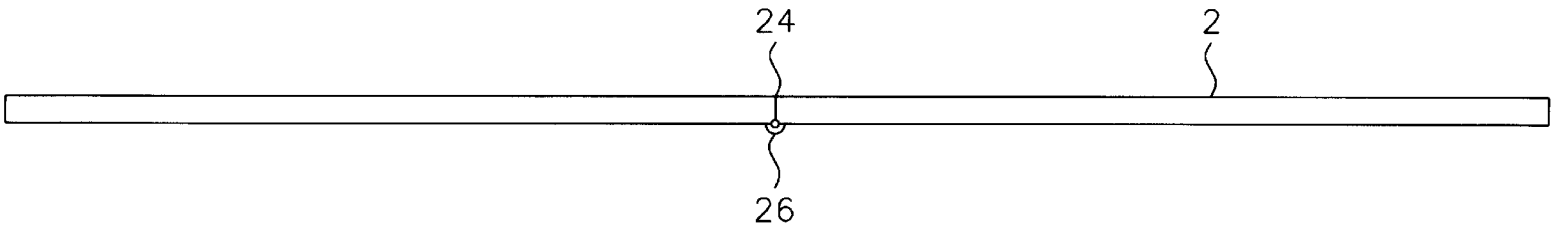
FIG. 2 is an end view of the base plate member shown in FIG. 1, illustrating how the base plate may be constructed with a hinge to allow it to fold over on itself.
Figure 3:
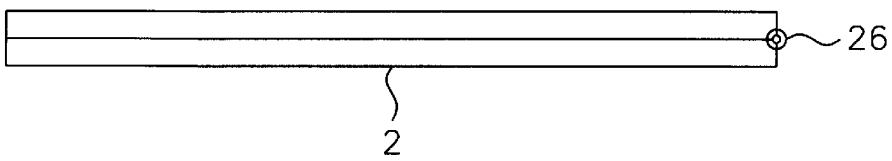
FIG. 3 is an end view of the base plate in a folded position.
Figure 4:
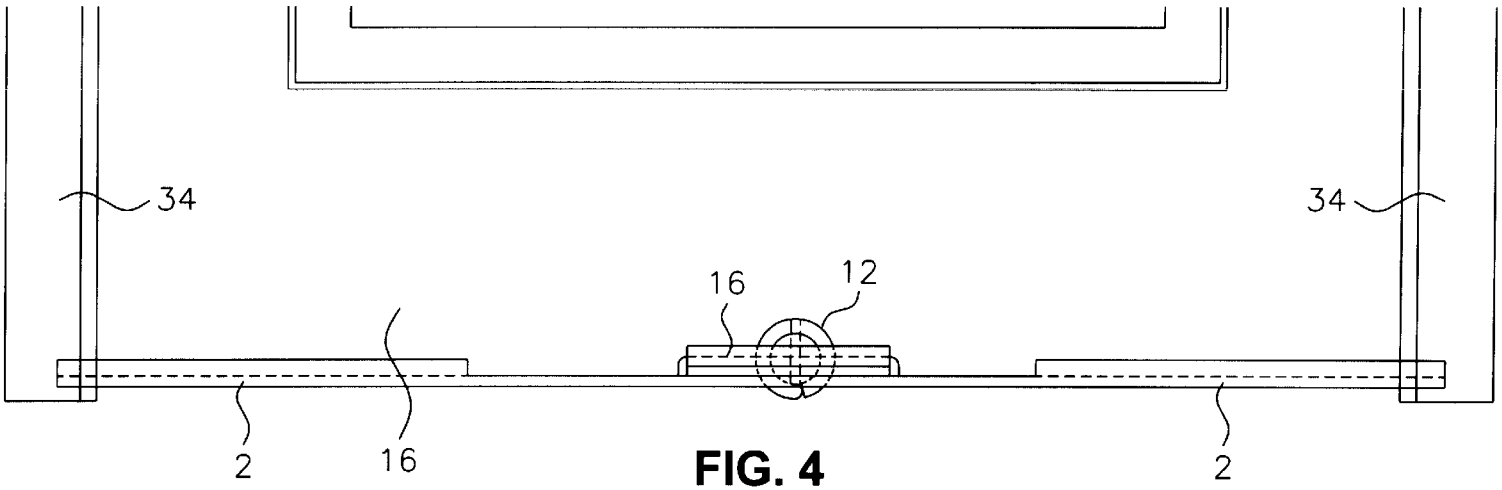
FIG. 4 is a ghosted end view of the invention illustrating its positioning, and a position of its three major components as engaged in operation without a locking device in place.
Figure 7:
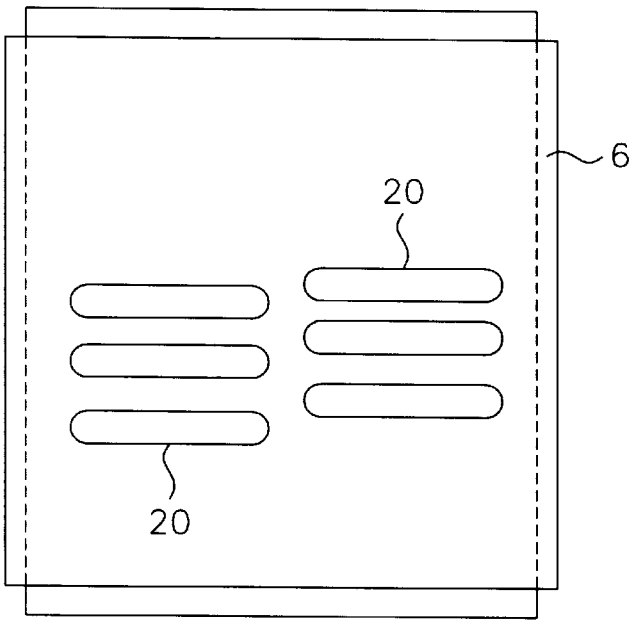
FIG. 7 is a plan view of a typical cover plate.
Figure 8:
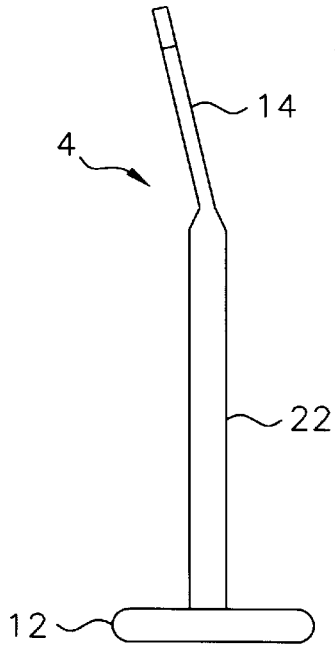
FIG. 8 is a plan view of a typical locking pin showing its various components and a variation of the tail portion of the pin which would protrude into the interior portion of the premises to be secured.
Figure 9:
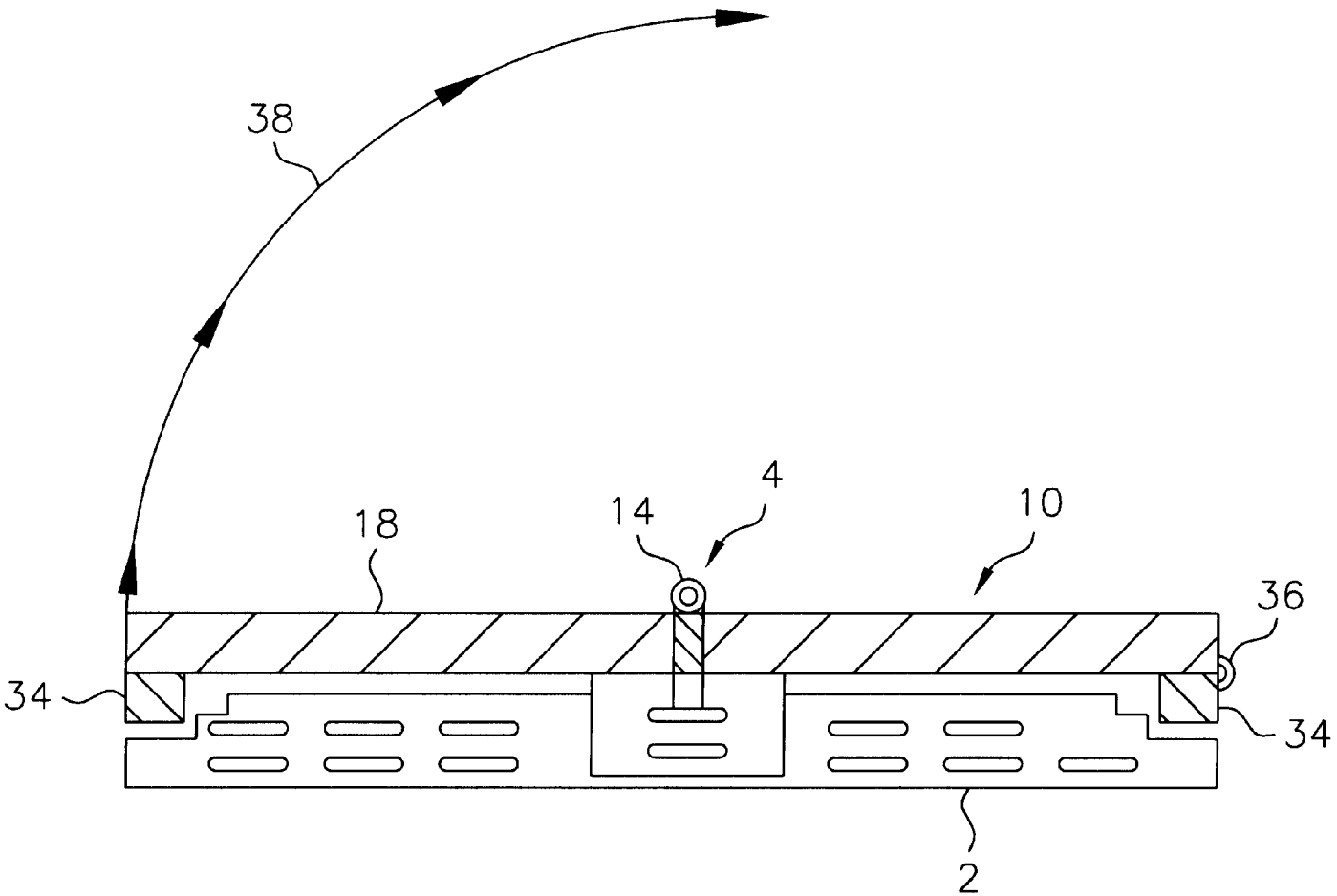
FIG. 9 is a top, plan view of the invention in place illustrating positioning of a single locking pin with a 90 degree elbow style tail and a single cover plate.

Reference will now be made to the various Figures wherein like numbers represent like parts. The present invention is comprised of essentially three major components. A base member shown in FIG. 1, a cover plate 6 shown in FIG. 7, and a locking pin 4 shown in FIG. 8. Turning to FIG. 1, base member 2 is shown in top plan view, in an embodiment which includes the ability to fold member 2 at member joint 24 as a result of a base member hinge 26, illustrated separately by an end view shown in FIG. 2 and FIG. 3. FIG. 2 shows an end view of base member 2 in an open position, essentially describing the member in the same configuration as shown from the view in FIG. 1 looking from the top down. FIG. 3 shows base member 2 in a folded position. A folding of base member 2 allows for more convenient travel and handling, although it will be appreciated that without the folding mechanism provided, base plate 2 would function in a similar fashion as that illustrated in the present disclosure. Base member 2, in the preferred embodiment, is a metal plate which is approximately 40 inches across at its longest edge 42 and is approximately 18 to 20 inches long at its shortest edge 44. The width of the plate which comprises as the base member is approximately 3 inches between long edge 42 and short edge 44. This embodiment works well with the length of the door jamb 40 between approximately 3½ inches to approximately 7 inches.

An average entry door to a home, apartment, office or other premises is normally 36 inches, but may be as little as 30 inches or as much as 42 inches or more.

Figure 5:
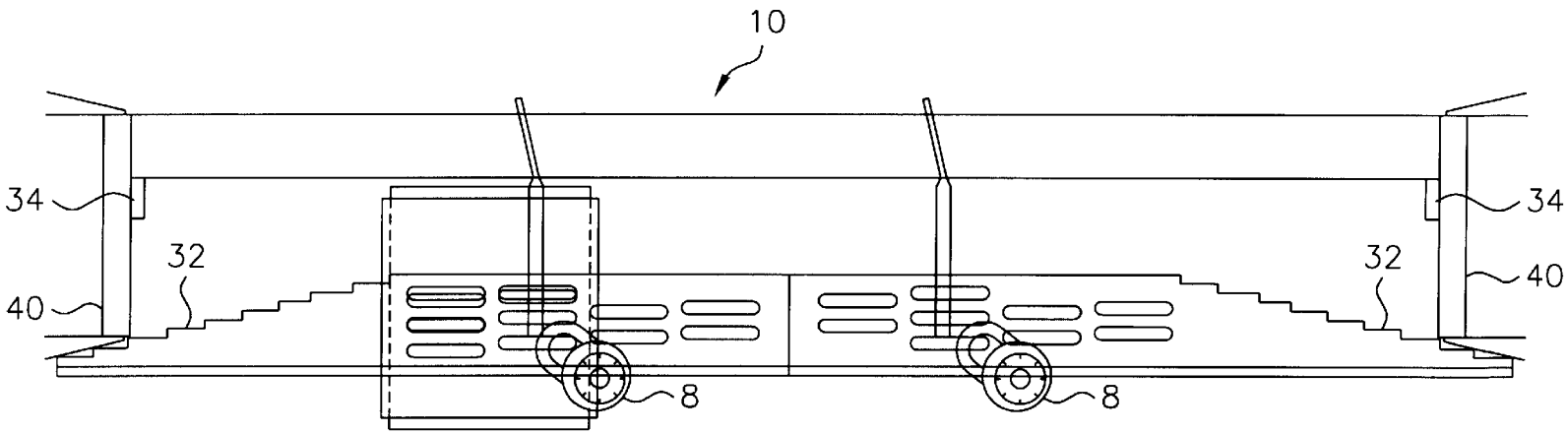
FIG. 5 is a top plan view showing an embodiment of the invention placed in operation with two separate sets of locking pins, two separate locking devices and one of the cover plates ghosted in a typical position for securing the base plate and the pin.

Turning to FIG. 5, a plan view of a typical apartment or other dwelling place entrance door is shown, with the disclosed external door lock mechanism actually in place. Secured door 10 is in the normally closed position, resting against door jambs 34 in a conventional fashion. In order to secure door 10 without access to the interior of the door or the locking mechanism within the dwelling or office to be secured, pin 4 is first placed underneath the door opening and rotated about the locking pin axis of shank 22, such that the locking pin tail not only protrudes past door 10 into the interior area of the room to be locked, but further is rotated about the axis such that tail 14 will interfere with the door interior side 18 if anyone attempts to open the door that is being secured.

Figure 6:
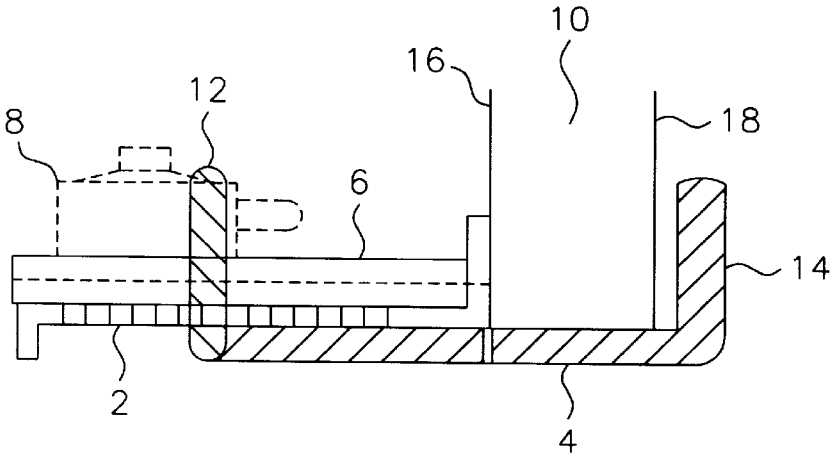
FIG. 6 is an end view illustrating the operation of the locking pin, and its orientation with respect to the base plate member and the cover plate.

FIG. 6 provides a ghosted end view of the locking mechanism illustrating how tail 14 of pin 4 can be slipped under the door 10 and then rotated such that tail 14 is in a generally upright position. As can be seen comparing FIG. 6 and FIG. 8, it is possible that pin 4 can be machined in various configurations such that the angle of pin tail 14 varies depending on the amount of clearance that one may expect between the bottom edge of door 10 and the door sill, which may be used to secure the gap between the bottom of the door and the floor adjacent to the bottom door edge.

Once pin 4 is inserted in place underneath the door to be secured, base member 2 is placed across the threshold of the door, and in a position which the locking pin head 12 will slip neatly through one of the cover plate lock slots as shown separately in FIG. 1. Base member 2 is designed with a variety of cover plate lock slots 20, such that it is unnecessary to have different sizes and shapes of member 2 for varying sizes and configurations of doors to be secured. As can be seen from FIG. 1, and more particularly in FIG. 5, the locking pin head 12 will generally fit within any slot 20, which is convenient, after adjusting base member 2 to the left or to the right such that pin head 12 falls through a slot. Returning to FIG. 6, it can be appreciated that after fitting pin head 12 through the base member slot as described, base plate 6, as separately detailed in FIG. 7, can be placed over locking pin head 12 allowing a securing means such as a combination lock to be slipped through openings in the locking pin head 12, thereby securing the locking mechanism in the locked position. Whether utilizing a single base plate 6 or a pair of plates as suggested in FIG. 5, it is possible to secure door 10 on the external side of the door such that a premises may be locked from the outside without access to the interior of the premises.

Base member 2 is constructed with ridges or undulated flanges 32 as shown in FIG. 1 and in FIG. 5. The size of the door to be secured, as well as the width of door jambs and door frame trim, may be in all sizes and dimensions. The undulated surfaces, as illustrated in FIG. 5, allow the adjustment of base member 2 such that there may be a tight fit, with little play, where base member 2 contacts door frame 40. It can be appreciated by considering the plan view of FIG. 5 that the gradations or undulations on the flange of base member 2 allows imprecise alignment of the member when measuring its alignment as a function of how close to parallel base member 2 is with the door external side 16. Even without exact or precise fit, it has been observed that the locking mechanism functions well and prevents door 10 from being opened regardless of whether such an attempt is from the outside or inside of the premises to be secured.

It can be appreciated from the foregoing description and various embodiments provided that numerous changes or modifications may be made without the departing from the spirit or the scope of the invention as defined by the following claims. Although certain preferred embodiments are presented for the purpose of describing the applications of the present invention either presently manufactured by the inventor or otherwise shown to satisfactorily operate, other such species or derivations from the thrust of the invention presented are considered within the scope of the following claims.

What is claimed is:

1. A locking bracket for securing a hinged door from the non-hinged side of such door, wherein said door is comprised of a door panel attached to a door frame through at least one hinge which allows the said door panel to open through said door frame comprising:

a base member disposed to fit abreast of the said door frame from the non-hinged side of the door panel; and a locking pin disposed to extend across said door frame through any space between said door frame and said door panel, said pin contacting an edge of said door panel opposite the side of said door panel where said base member is located;

wherein said base member contains at least one opening within its body to receive a portion of the said locking pin;

wherein further said locking pin is disposed to receive a locking means whereby said locking means secures said locking pin to said base member to prevent removal of said locking pin.

2. The locking bracket of claim 1 further including a cover plate, wherein said cover plate contains at least one opening to receive a portion of said locking pin and secure said locking pin to said base member.

3. The security device of claim 1 wherein said locking pin is substantially cylindrical in shape, and further comprises a tail protruding beyond the body of said pin to intercept the said door panel.

4. A locking bracket for securing a door from the non-hinged side of said door, where said door uses hinges which attach said door to a door frame, said locking bracket comprising a substantially flat base member having at least one opening to receive a head portion of a locking pin;

a locking pin disposed to extend across said door frame through any space between said door frame and said door panel, wherein said locking pin is comprised of a head portion dimensioned to protrude through the said at least one opening in said base member, wherein further said locking pin includes a tail portion which protrudes at an angle from the longitudinal axis of said locking pin; and a cover plate dimensioned to fit between said door to be secured and said base member, said cover plate having at least one opening designed to operatively connect the said head portion of the locking pin, said base member and the cover plate.

5. A locking device for securing a door to a door frame supporting the door by hinges, the said door being of the type having an outer side and an inner side on the hinged side of said door, the locking device comprising;

a first plate which is shaped to extend between and contact two opposite sides of said door frame on the non-hinged side of said door and adjacent to any opening between the inner side and outer side of said door;

a locking pin comprised of a head portion, a shank and a tail portion, the tail portion of said pin being disposed for engaging the inner surface of the door and the head portion of said pin being disposed for engaging the first plate; and a second plate with at least one opening therein for receiving the said head portion of said locking pin, said head portion of said locking pin disposed to accept a lock for securing the first and second plate to the locking pin when the door is closed.

6. A locking device for securing a door to a door frame pivotally supporting the door for swinging movement between a closed position and an open position, and said door being of the type having a space between the hinged and non-hinged side of the door and located at the bottom of said door, the locking device comprising;

a first plate containing at least one opening and projecting between at least two opposite edges of the door frame in position to engage members of the door frame on the non-hinged side of said door when the door is in the closed position;

a pin including a portion extending through the said space between the hinged and non-hinged side of said door and a head for securing the pin to the first plate, and a tail portion disposed to contact the hinged side of said door; and a second plate having an opening therein for receiving the head of said pin, wherein said second plate is dimensioned to contact the outer side of said door to secure the first plate and the pin together to prevent movement of said door.

7. A locking device for securing a door to a door frame pivotally supporting the door, the door frame being of the type having members which border the door attached to the frame, and the intended door being of the type having a space between the door surfaces which comprise a hinged and a non-hinged side of said door, the locking device comprising a first plate containing at least one opening and projecting between at least two opposite edges of the door frame in position to engage members of the door frame;

a pin including a portion extending through the said space between the hinged and non-hinged side of said door and a head for securing the pin to the first plate, and a tail portion disposed to contact the hinged side of said door; and a second plate having an opening therein for receiving the head of said pin, wherein said second plate is dimensioned to contact the non-hinged side of said door to secure the first plate and the pin when a locking means is engaged.

* * * * *